US006398076B1

(12) United States Patent
Giblin et al.

(10) Patent No.: US 6,398,076 B1
(45) Date of Patent: Jun. 4, 2002

(54) FITMENT AND BOTTLE

(75) Inventors: Edward John Giblin, Hopatcong, NJ (US); Gregory Alan Lathrop, Southbury, CT (US)

(73) Assignee: Unilever Home & Personal Care USA, division of Conopco, Inc., Greenwich, CT (US)

( * ) Notice: Subject to any disclaimer, the term of this patent is extended or adjusted under 35 U.S.C. 154(b) by 0 days.

(21) Appl. No.: 09/224,209

(22) Filed: Dec. 30, 1998

(51) Int. Cl.[7] ..... B67D 1/00
(52) U.S. Cl. ..... 222/109; 222/544; 222/568
(58) Field of Search ..... 222/108, 109, 222/111, 544, 545, 547–549, 566–568, 570, 571

(56) References Cited

U.S. PATENT DOCUMENTS

| | | | | | |
|---|---|---|---|---|---|
| 2,601,040 | A | * | 6/1952 | Livingstone | 222/109 |
| 2,743,844 | A | * | 5/1956 | Livingstone | 222/111 |
| 4,128,189 | A | | 12/1978 | Baxter | 222/109 |
| 4,550,862 | A | | 11/1985 | Barker et al. | 222/109 |
| 4,671,421 | A | | 6/1987 | Reiber et al. | 215/228 |
| 4,696,416 | A | | 9/1987 | Muchenfuhs et al. | 222/109 |
| 4,706,829 | A | | 11/1987 | Li | 215/354 |
| 4,890,770 | A | | 1/1990 | Haga et al. | 222/109 |
| 4,917,269 | A | | 4/1990 | Fuchs et al. | 222/109 |
| 5,058,772 | A | | 10/1991 | Moore et al. | 222/109 |
| 5,108,009 | A | | 4/1992 | Davidson et al. | 222/109 |
| 5,131,566 | A | | 7/1992 | Bavegems | 222/80 |
| 5,141,138 | A | * | 8/1992 | Odet et al. | 222/109 |
| 5,207,356 | A | * | 5/1993 | Krall | 222/109 |
| 5,251,788 | A | | 10/1993 | Moore | 222/111 |
| 5,435,467 | A | | 7/1995 | Ekkert et al. | 222/109 |
| 5,462,202 | A | | 10/1995 | Haffner et al. | 222/109 |
| 5,509,579 | A | * | 4/1996 | Robbins, III | 222/109 |
| 5,941,422 | A | * | 8/1999 | Struble | 222/109 |

* cited by examiner

*Primary Examiner*—J. Casimer Jacyna
(74) *Attorney, Agent, or Firm*—Gerard J. McGowan, Jr.

(57) ABSTRACT

A fitment and the combination of fitment and bottle and/or closure, particularly for dispensing household products such as heavy duty liquid detergents and fabric softeners. The fitment of the invention comprises an outer circumferential wall which extends upwardly, a connecting web extending inwardly, a downwardly extending inner circumferential wall, a floor extending inwardly from the bottom of the inner circumferential wall, and a pour spout extending upwardly from an inner end of the floor. The inner circumferential wall includes internal fasteners suitable for securing a closure to the fitment. The fitment may be secured to the container finish by complementary fasteners such as internal threads on the fitment and external threads on the finish.

The fitment finds particular utility in containers wherein the bottle body is translucent or transparent. Preferably, at least 50% of the area bounded by the outermost wall of the fitment is open to the interior of the bottle, most preferably at least 75% and still more preferably at least 80%. Likewise, it is preferred that the base of the spout be disposed as far forward as possible in the pouring position to minimize the distance between the bottom of the spout and the front of the fitment. The fitment may be transferred from a first bottle to a second one after the contents of the first are depleted.

21 Claims, 5 Drawing Sheets

FITMENT AND BOTTLE

BACKGROUND OF THE INVENTION

Heavy duty liquid detergent products have grown in popularity over recent years. The sale of such products in specialized dispensing packages, usually including a combined measuring cup/closure, and a drainback fitment/spout has aided the consumers in the use of such products.

While drainback containers have enhanced the convenience of the use of heavy duty liquid detergents and other products, still some problems exist. Many of the containers include fitments which extend well below the top of the container finish into the bottle. The problem which this presents is that it is sometimes difficult to pour out from the container the last drops of product since product becomes entrapped between the fitment and the container finish when the bottle is in the inverted, pouring, position. This is especially true of "see-through" containers, which can be expected to maximize consumer frustration with the inability to utilize the entire product present within the container. It would also be desirable to provide the container with improved flexibility. For instance a screw-on screw-off fitment would permit use of the fitment in the consumer's discretion.

Barker et al., U.S. Pat. No. 4,550,862 discloses a dispenser package which includes a transition collar having an extended pour spout and a transverse partition with a drain to collect and return residual liquid to the container. A measuring cup has an open mouth with threads on its exterior to attach to the cup on the interior of the transition collar. The measuring cup acts as a closure for the package. The bottle finish has external threads that mate with internal threads on the transition collar.

Muchenfuhs et al., U.S. Pat. No. 4,696,416 is directed to a package similar to that of Barker et al. except that a drip concentrating member is present in the lowermost surface of the drainback partition.

Davidson et al., U.S. Pat. No. 5,108,009 discloses a package having a spout-containing fitment wherein external threads on the package finish cooperate with internal threads on a closure/measuring cup. The Davidson et al. bottle includes a locking circumferential ridge on an inner peripheral surface of the upper end portion of the bottle fitment (see FIGS. 9 and 10), which retains the fitment.

Baxter, U.S. Pat. No. 4,128,189 is directed to a container for viscous fluids having an insert provided with a pouring lip. A cover includes a flange to engage a flange on the fitment when the cover is closed. As seen in FIG. 4, inner aspects of the finish appear to extend inwardly against the fitment and cover. The finish has outwardly extending threads cooperating with inwardly extending threads of a cap.

Bavegems, U.S. Pat. No. 5,131,566 discloses a transition piece having internal threads cooperating with external threads on a container finish. The transition piece includes a spout. The patent mentions that by attaching the transition piece by a screw head, if the user prefers not to use the pouring spout, but prefers to fill it by the free neck opening, this can be done easily by unscrewing the transition piece. The preferred embodiment is said to disclose a refill facilitating pouring spout which is part of a transition piece with inside screw head for fastening to the container cap.

Li, U.S. Pat. No. 4,706,829 discloses a dispensing package including a bottle finish having outwardly extending threads mating with a cap having inwardly extending threads. A pour spout-containing fitment is mounted on the bottle finish.

Moore, U.S. Pat. No. 5,251,788 discloses a closure having interior threads designed to engage exterior threads on a spout body. The spout body includes internal threading which mates with external threading on the container finish.

Ekkert et al., U.S. Pat. No. 5,435,467 is directed to a container having an externally threaded finish which mates with an internally threaded finish of a closure. A fitment having a radially extending flange is inserted within the mouth of the container and the radially extending flange rests upon the top of the finish. The arrangement is such that the amount of residual contents left within the container is said to be diminished. The illustrated spout fitment appears to have substantial areas open for product to flow through, relative to the area defined by the outer spout wall.

Haga et al., U.S. Pat. No. 4,890,770 discloses a package having outer threads mating with inner threads of an adapter which has a pour spout. The adapter has outer threads which mate with inner threads on a closure. The closure includes a flange which rests on a portion of the adapter.

Haffner et al., U.S. Pat. No. 5,462,202 is directed to a liquid dispensing fitment which rests on an upper edge of the container finish. The container finish includes outside extending screws which mate with inwardly extending screws on the closure. The fitment includes a pour spout.

Fuchs et al., U.S. Pat. No. 4,917,269 discloses a package having a neck comprising an upwardly extending integral dispensing spout. Internal threads on the container finish cooperate with external threads on the closure. The closure also includes an annular flexible sealing ring and a second sealing ring.

Moore et al., U.S. Pat. No. 5,058,772 discloses a dispensing package including a finish having outer threads which mate with inner threads on a spout fitment. The spout fitment also has outer threads which mate with inner threads on a closure.

Reiber et al., U.S. Pat. No. 4,671,421 discloses a plastic blow molded container having an annular finish and an insert positioned in the finish and interengaged with the internal surface of the finish. The insert has internal threads for receiving a closure which may be in the form of a self draining measuring cup having external threads on the lower end thereof and a peripheral flange sealingly engaging the free end of the finish. In one form, the insert is placed in position while the finish is hot, and when the finish cools it shrinks into sealing engagement with the finish. In another form, the insert is spin welded into sealing engagement with the finish. Alternatively, an adhesive may be used.

SUMMARY OF THE INVENTION

The present invention is directed to a fitment and the combination of fitment and bottle and/or closure which can meet many of the unrealized goals of modern household products dispensing, particularly dispensing of heavy duty liquid detergents and fabric softeners. The fitment of the invention comprises an outer circumferential wall which extends upwardly, a connecting web extending inwardly, a downwardly extending inner circumferential wall, a floor extending inwardly from the bottom of the circumferential wall, and a pour spout extending upwardly from an inner end of the floor, wherein the inner circumferential wall includes internal fasteners suitable for securing a closure to the fitment. The fitment may be secured to the container finish by complementary fasteners such as internal threads on the fitment and external threads on the finish. The fitment may also be secured to the finish as by hot melt adhesive or by spin welding or other mechanisms taught in U.S. Pat. No.

4,671,421 which is hereby incorporated by reference herein. Also, the fitment may be secured to the bottle by threads and/or anti-rotational lugs. The anti-rotational lugs and/or ribs may be internal to the bottle and mate with complementary lugs or ribs on the closure.

The present design permits the use of a spout disposed high in the bottle neck and having no aspects lower than the base of the collar of the bottle. The fitment may mate with a closure having external fasteners which are complementary to internal fasteners on the fitment. It is believed by many that the use of an externally threaded closure results in a neater dispensing of product. Preferably, the lowest point of the floor of the fitment does not extend below the lowest point of the outer circumferential wall. Moreover, more preferably, the lowest point of the floor and/or fitment does not extend below the base of the neck of the bottle.

In a preferred embodiment, the floor is dome-shaped and more funnel like when the spout and bottle are inverted. If desired, the floor of the spout may be made with two different angles to aid in drainback. For example, forward of the spout the angle to the inner circumferential wall could be 7° and on sides of spout the floor angle would be 4°.

The fitment of the invention finds particular utility in containers wherein the bottle body is translucent or transparent. In such containers it is particularly important to be able to dispense the final drops of the product to avoid dissatisfaction on the part of consumers.

In a particularly preferred embodiment at least 50% of the area bounded by the outermost wall of the fitment is open to the interior of the bottle, most preferably at least 75% and still more preferably at least 80%. This minimizes the amount of residual liquid which can be trapped between the fitment and the bottle. Likewise, it is preferred that the base of the spout be disposed as far forward as possible in the pouring position to minimize the distance between the bottom of the spout and the front of the fitment, again to decrease the amount of liquid trapped when the contents of the container are almost fully depleted. If so desired, the fitment includes a securing structure, e.g. ribs which mate with a complementary structure in the bottle to prevent turning or removal.

Preferably the fitment includes a pouring axis extending from a first end of said fitment through said spout to a second end of said fitment, said axis bisecting said spout and extending in a direction of pouring of the product wherein said spout includes a base which intersects with said floor and wherein a point where said base intersects with said axis is at least 75% of the distance from said first end of said fitment to said second end.

Concomitant with the forward placement of the drainback spout is a minimization of the angle of drainback slope. In the present invention it is minimized to between 4° and 10°.

The fitment of the innovation may be portable. For instance, where it is not permanently secured to the bottle, it may be transferred from a first bottle to a second bottle when the first has been depleted.

For a more complete understanding of the above and other features and advantages of the invention, reference should be made to the following detailed description of preferred embodiments and to the accompanying drawings.

DETAILED DESCRIPTION OF THE INVENTION

Figure 1:
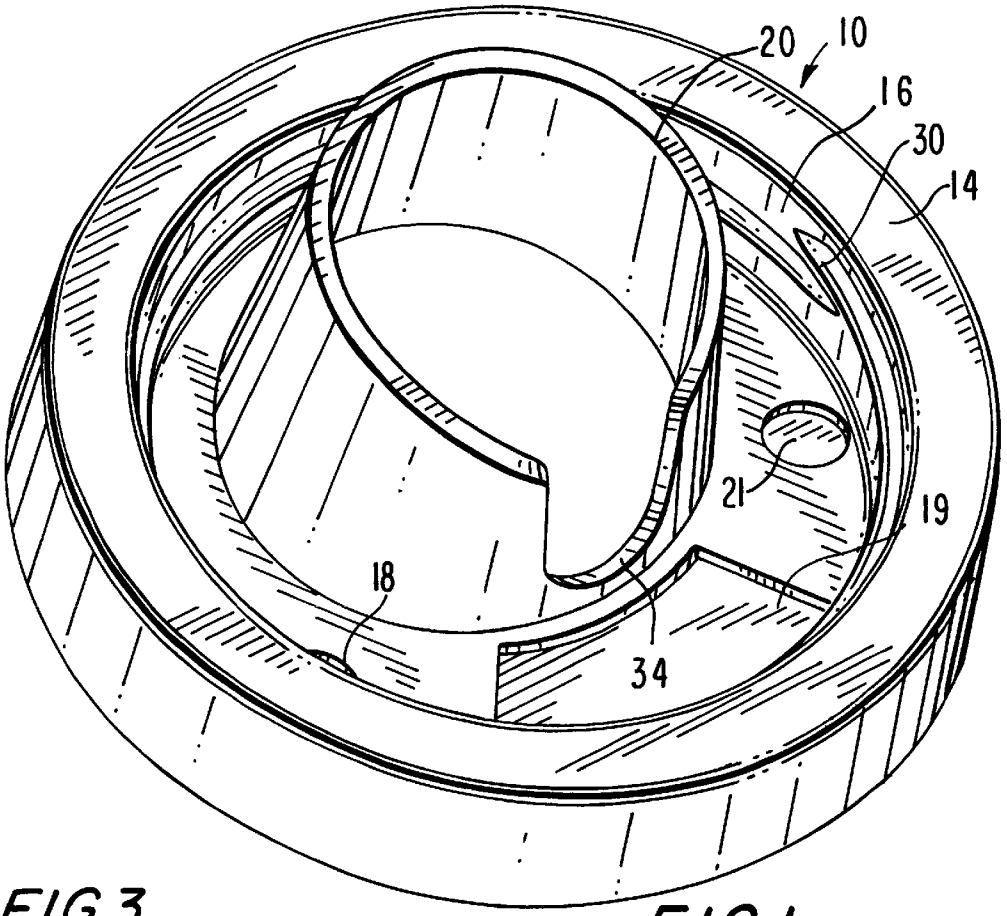
FIG. 1 is a perspective view of a fitment according to the invention.
Figure 3:
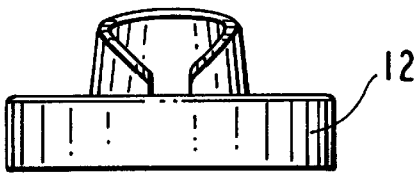
FIG. 3 is a rear elevational view of the fitment of FIG. 1.
Figure 5:
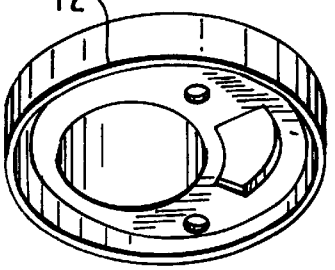
FIG. 5 is a bottom perspective view of the fitment of FIG. 1.
Figure 2:
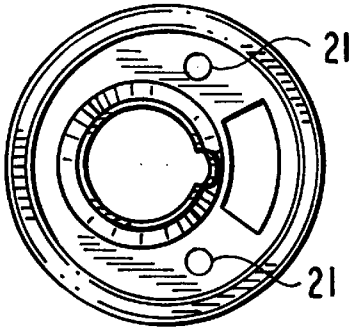
FIG. 2 is a top plan view of the fitment of FIG. 1.
Figure 4:
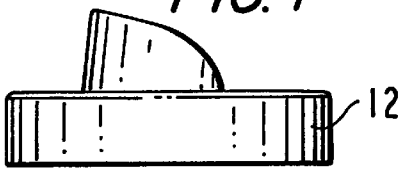
FIG. 4 is a side elevational view of the fitment of FIG. 1.

Fitment 10 (FIGS. 1, 3) comprises outer circumferential wall 12, inwardly extending web 14 and inner circumferential wall 16.

Inwardly extending from inner circumferential wall 16 is floor 18. At an inward end of floor 18 spout 20 rises upwardly. If so desired, floor 18 may be provided with drainback apertures 19 and 21. Inner circumferential wall 16 includes fasteners 30, which may be in the form of screw threads or otherwise.

Figure 13:
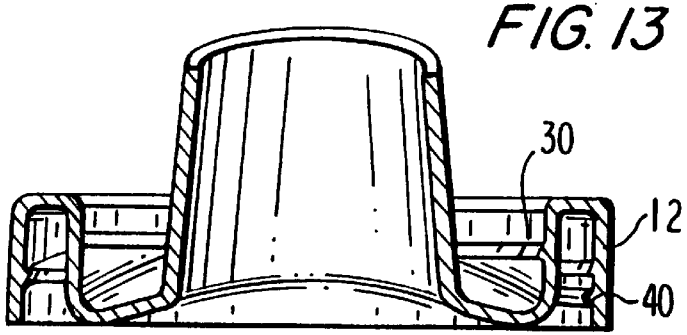
FIG. 13 is a rear cross sectional view of the fitment of FIG. 1.
Figure 14:
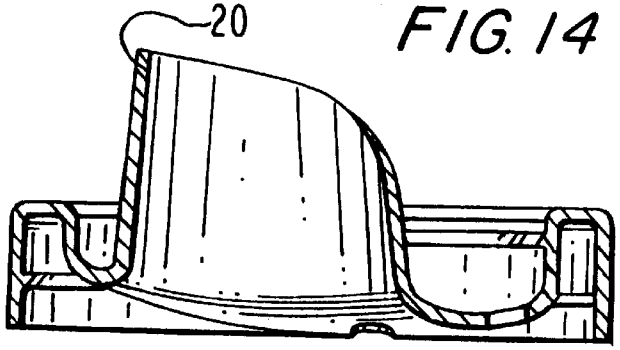
FIG. 14 is a side cross sectional view of the fitment of FIG. 1.

Spout 20 may be frustoconical as illustrated and may include slot 34 (see, e.g. FIG. 6) as has been known in the art. As best seen in FIGS. 13 and 14, the inner surface of outer circumferential wall 12 may include fasteners 40 which may be in the form of threads or otherwise for engaging outer fasteners on the finish of a bottle.

Floor 18 slopes downwardly toward apertures 21 and 19 to facilitate drainback of liquid.

Figure 7:
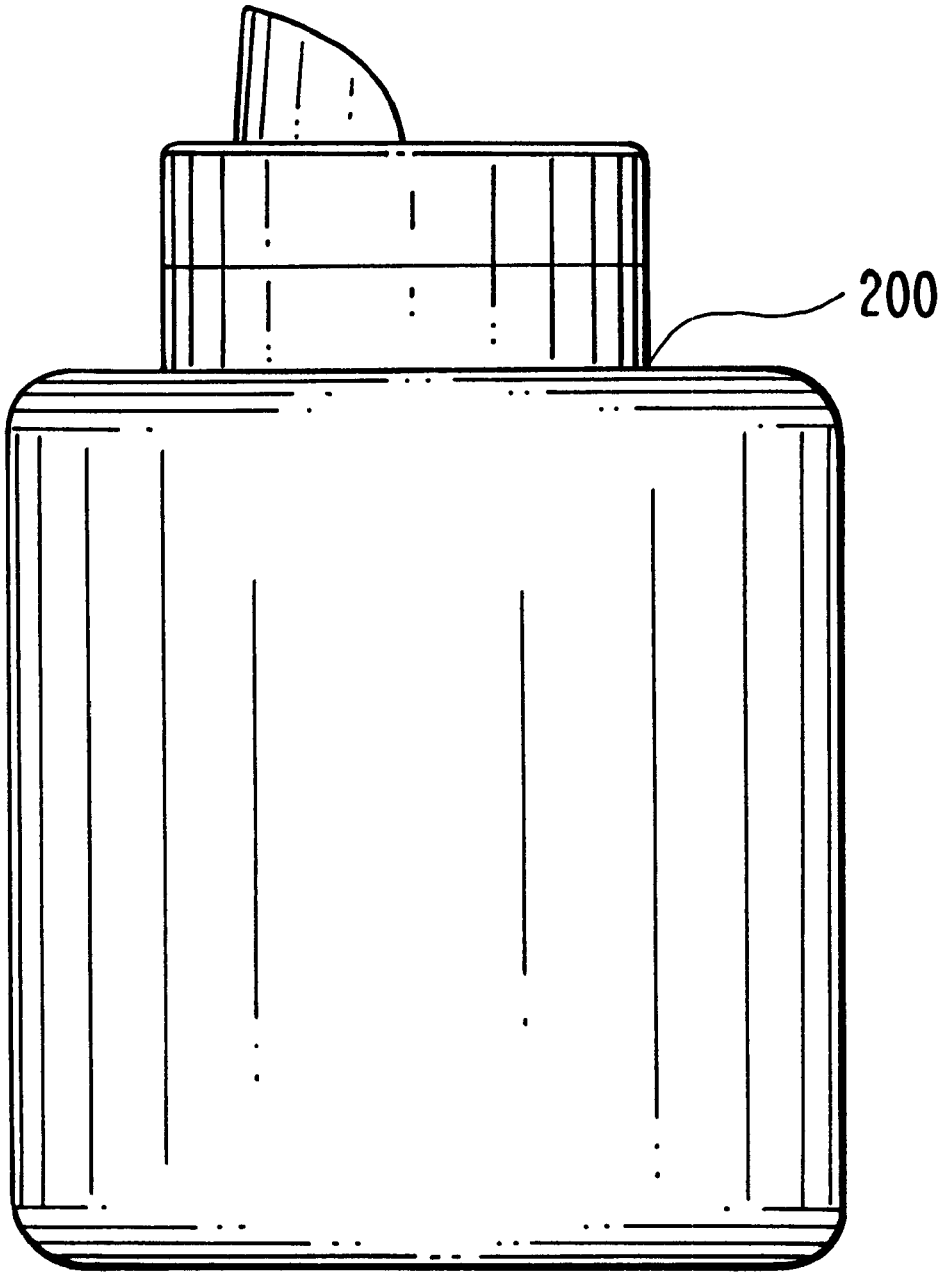
FIG. 7 is a side elevational view of a bottle plus fitment according to the invention.

FIG. 7 shows a bottle 200 having a fitment according to the invention.

Figure 8:
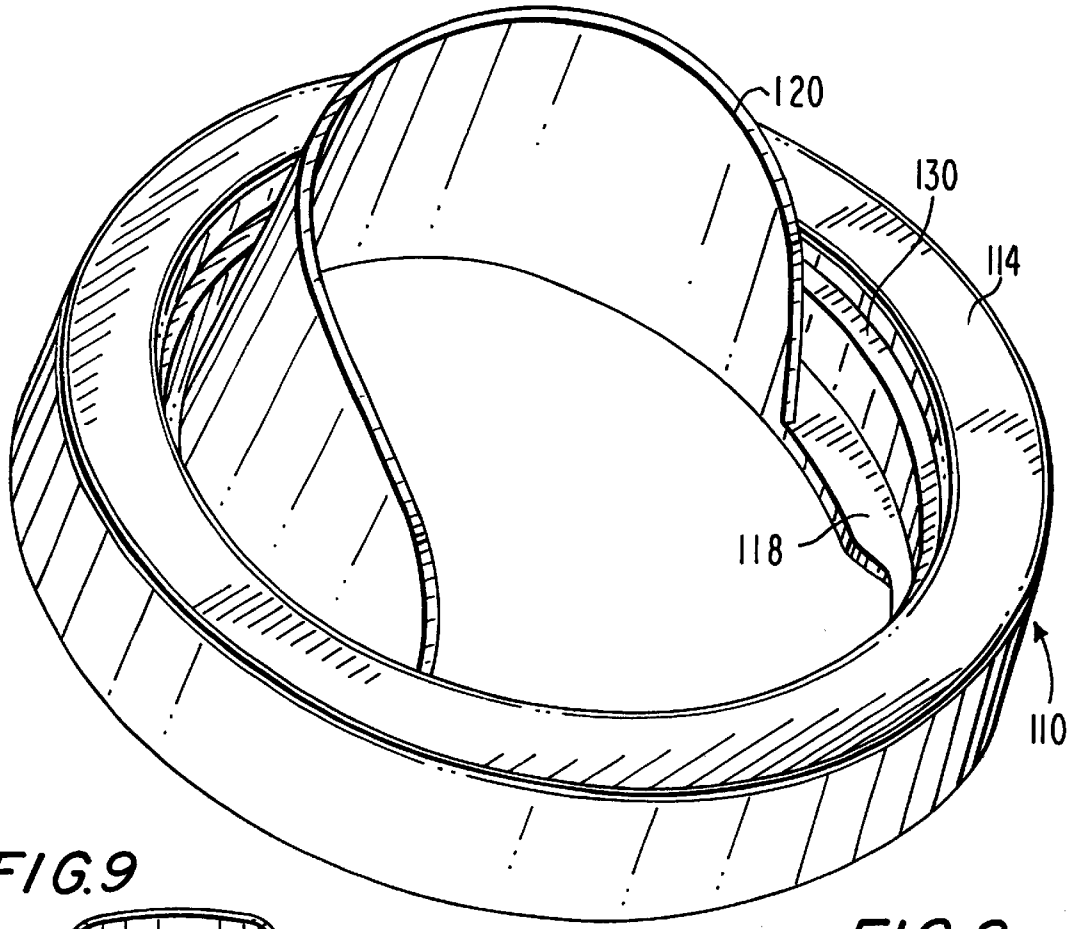
FIG. 8 is a perspective view of a alternative fitment according to the invention.
Figure 9:
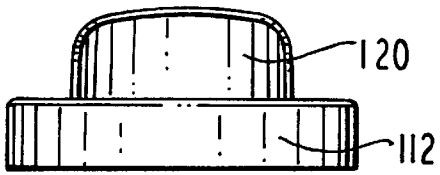
FIG. 9 is a rear elevational view of the fitment of FIG. 8.
Figure 10:
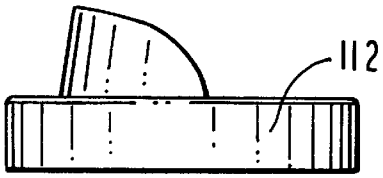
FIG. 10 is a side elevational view of the fitment of FIG. 8
Figure 11:
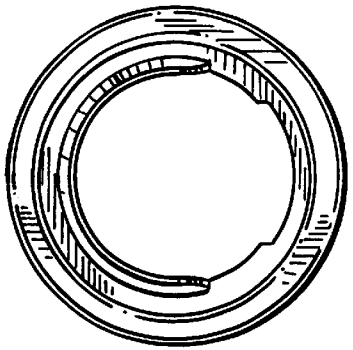
FIG. 11 is a top plan view of the fitment of FIG. 8.
Figure 12:
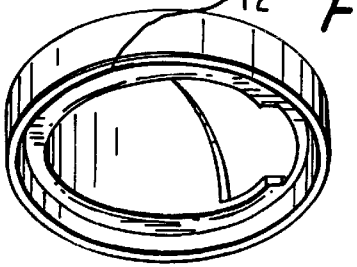
FIG. 12 is a bottom perspective view of the fitment of FIG. 8.

A preferred embodiment is illustrated in FIG. 8 et seq. Fitment 110 comprises outer circumferential wail 112, inwardly extending web 114 and inner circumferential wall 116.

Inwardly extending from inner circumferential wall 116 is floor 118. At an inward end of floor 118 spout 120 rises upwardly.

Inner circumferential wall 116 includes fasteners 130, which may be in the form of screw threads or otherwise.

Figure 16:
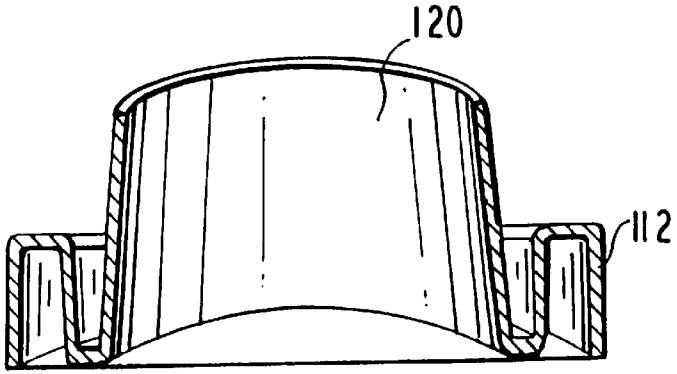
FIG. 16 is a rear cross sectional view of the fitment of FIG. 8.
Figure 17:
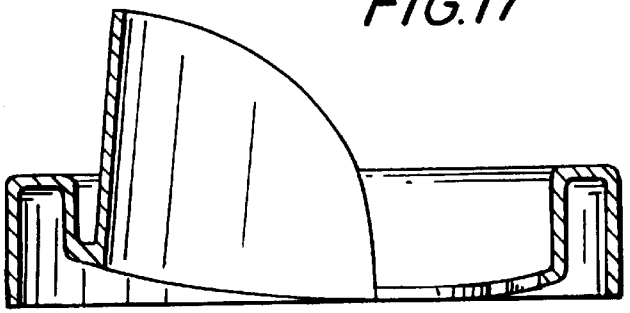
FIG. 17 is a side cross sectional view of the fitment of FIG. 15.

The inside of outer circumferential wall 112 may include fasteners 140 which may be in the form of threads or otherwise for engaging outer fasteners on the finish of a bottle. Or, as seen in FIGS. 16 and 17, the fasteners may be omitted in which case the fitment may be secured to the bottle in an alternative way, e.g. by spin welding.

Fitment 110 is particularly advantageous in that it includes a very large open area through which product can travel and, more importantly, the closed area in which product can become trapped when the bottle is inverted is minimized.

Figure 18:
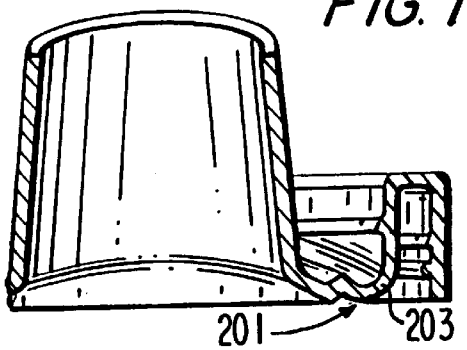
FIG. 18 is a fragmentary view similar to FIG. 13 showing a domed product drainage floor.
Figure 15:
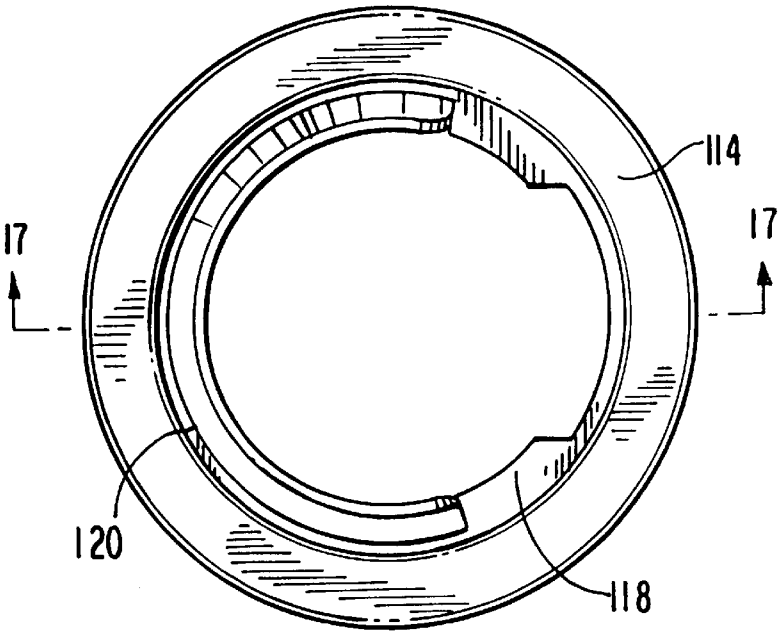
FIG. 15 is an enlarged top plan view of the fitment FIG. 8.

As seen in FIG. 18, the product drainage floor 203 may be domed as at 201 to create a funnel for product when the fitment is inverted. The floor may slope downwardly from front to rear to promote product drainage notwithstanding the domed floor.

Figure 6:
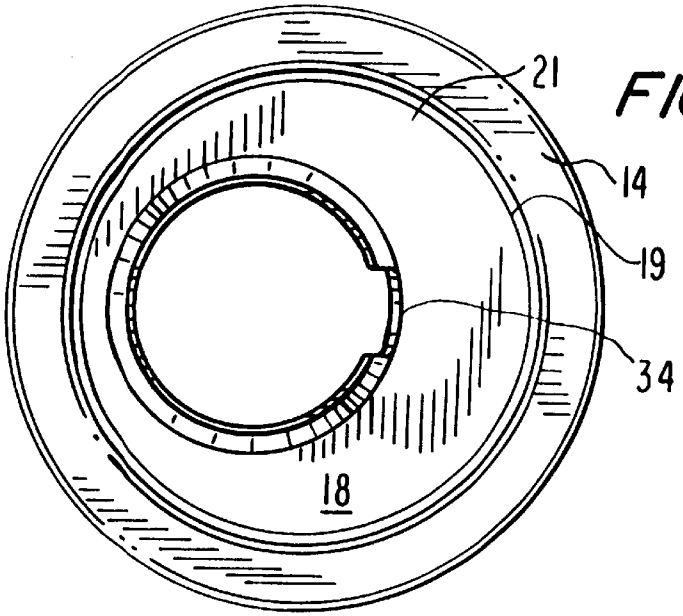
FIG. 6 is an enlarged top plan view of the fitment of FIG. 1.

In FIG. 6, pouring axis 310 is shown extending from a first end of the fitment through the spout to a second end of the fitment, the axis bisecting the spout and extending in a direction of pouring of the product.

The fitment of the invention is preferably made of a homopolymer or copolymer of polypropylene. The bottle of the invention is preferably made of polypropylene, which may be clear. Other even more preferred materials include thin walled materials such as high density polyethylene.

The closure of the invention may be made by injection molding of a homopolymer or copolymer of polypropylene.

As will be appreciated by those of ordinary skill in the art, homopolymer polypropylene is harder than copolymer polypropylene. If the closure is made of one, then the spout should be made of the other. That is, a combination of harder and softer materials should be utilized to form the best seal.

Most preferably, the lowest point of the floor and/or fitment does not extend below the base of the neck of the bottle.

If so desired, the fitment includes a securing structure, e.g. ribs which mate with a complementary structure on the bottle to prevent turning or removal.

It should be understood of course that the specific forms of the invention herein illustrated and described are intended to be representative only as certain changes may be made therein without the departing from the clear teachings of the disclosure. Accordingly, reference should be made to the following appended claims in determining the full scope of the invention.

What is claimed is:

1. A fitment comprising an outer circumferential wall extending upwardly, a connecting web extending inwardly from a top end of said wall, a downwardly extending inner circumferential wall, a floor extending inwardly from a bottom of said inner circumferential wall, a pour spout having a bottom and extending upwardly from an inner end of said floor, said inner circumferential wall including internal fasteners suitable for securing a closure to said fitment said outer circumferential wall having a bottom and said floor having a lowest point which does not extend below the bottom of said outer circumferential wall and said spout bottom not extending below the bottom of said outer circumferential wall.

2. The fitment according to claim 1 wherein said floor slopes downwardly from said inner circumferential wall to a drainage opening.

3. The fitment according to claim 1 wherein said fasteners comprise threads.

4. The fitment according to claim 1 wherein said floor has a highest point intermediate a point at which it joins said inner circumferential wall and a point at which it joins said spout.

5. The fitment according to claim 1 wherein said internal fasteners are screw threads.

6. The fitment according to claim 1 wherein at least 50% of the area bounded by the outer circumferential wall of the fitment is open to the interior of the bottle.

7. The fitment according to claim 1 wherein said fitment includes a pouring axis extending from a first end of said fitment through said spout to a second end of said fitment, said axis bisecting said spout and extending in a direction of pouring of the product wherein said spout includes a base which intersects with said floor and wherein a point where said base intersects with said axis is at least 75% of the distance from said first end of said fitment to said second end.

8. The fitment according to claim 7 wherein the point at which said spout base intersects with said axis is at least 80% of the distance from said first end of said fitment to said second end.

9. The fitment according to claim 8 wherein at least 50% of the area bounded by an outermost wall of the fitment is open to the interior of the bottle.

10. A bottle comprising a bottle body, a finish having external fasteners, and a fitment having an outer circumferential wall extending upwardly, a connecting web extending inwardly form a top end of said wall, a downwardly extending inner circumferential wall, a floor extending inwardly from said inner circumferential wall, and a pour spout extending upwardly from an inner end of said floor and having a bottom, said fitment further comprising internal fasteners on the inside of said inner circumferential wall for securing a closure to said fitment, said outer circumferential wall having a bottom and said floor having a lowest point which does not extend below the bottom of said outer circumferential wall and said spout bottom not extending below the bottom of the outer circumferential wall.

11. The bottle according to claim 10 wherein said floor slopes downwardly from said inner circumferential wall to a drainage opening.

12. The bottle according to claim 11 where the floor is disposed at at least two different angles relative to said inner circumferential wall to promote drainage.

13. The bottle according to claim 10 wherein said internal and external fasteners on said finish and fitment are screw threads.

14. The bottle according to claim 10 wherein said floor has a highest point intermediate a point at which it joins said inner circumferential wall and a point at which it joins said spout.

15. The bottle according to claim 10 wherein said bottle body is translucent.

16. The bottle according to claim 10 wherein at least 50% of the area bounded by the outer circumferential wall of the fitment is open to the interior of the bottle.

17. The bottle according to claim 10 wherein said fitment includes a pouring axis extending from a first end of said fitment through said spout to a second end of said fitment, said axis bisecting said spout and extending in a direction of pouring of the product, wherein said spout includes a base which intersects with said floor and wherein a point where said base intersects with said axis is at least 75% of the distance from said first end of said fitment to said second end.

18. The bottle according to claim 17 wherein at least 50% of the area bounded by an outermost wall of the fitment is open to the interior of the bottle.

19. The bottle according to claim 10 wherein said fitment is secured to said finish by hot melt adhesive.

20. The bottle according to claim 10 further comprising mating anti-rotational structure on said fitment and said bottle.

21. The bottle according to claim 10 wherein the lowest point of the fitment does not extend below the base of the neck of the bottle.

* * * * *